United States Patent [19]

Chaplin et al.

[11] Patent Number: 4,566,118

[45] Date of Patent: Jan. 21, 1986

[54] METHOD OF AND APPARATUS FOR CANCELLING VIBRATIONS FROM A SOURCE OF REPETITIVE VIBRATIONS

[75] Inventors: George B. B. Chaplin; Roderick A. Smith, both of Colchester, United Kingdom

[73] Assignee: Sound Attenuators Limited, Colchester, England

[21] Appl. No.: 522,172

[22] PCT Filed: Nov. 26, 1982

[86] PCT No.: PCT/GB82/00337

§ 371 Date: Jul. 25, 1983

§ 102(e) Date: Jul. 25, 1983

[87] PCT Pub. No.: WO83/02031

PCT Pub. Date: Jun. 9, 1983

[30] Foreign Application Priority Data

Nov. 26, 1981 [GB] United Kingdom ..... 8135628

[51] Int. Cl.[4] ..... F10N 1/06

[52] U.S. Cl. ..... 381/71; 381/94

[58] Field of Search ..... 381/71, 94, 56

[56] References Cited

FOREIGN PATENT DOCUMENTS

| | | |
|---|---|---|
| 0040462 | 11/1981 | European Pat. Off. . |
| WO81/01480 | 5/1981 | PCT Int'l Appl. . |
| 1199925 | 7/1970 | United Kingdom . |
| 1548362 | 7/1979 | United Kingdom . |
| 1555760 | 11/1979 | United Kingdom . |
| 1577322 | 10/1980 | United Kingdom . |
| 1583758 | 2/1981 | United Kingdom . |
| 2088951 | 6/1982 | United Kingdom . |

*Primary Examiner*—James L. Dwyer

*Attorney, Agent, or Firm*—Dann, Dorfman, Herrell and Skillman

[57] ABSTRACT

Primary vibrations from a repetitive source of such vibrations are nulled in a location by specially generated secondary vibrations fed to the location from an actruator. The actuator is driven by a waveform generator which is synchronized to the source by a synchronizing signal on the line which is derived otherwise than from the source. In FIG. 2, the synchronizing signal is derived from the output of a residual vibration sensor via a filter or a phase-locked loop (FIG. 3 and 4).

8 Claims, 5 Drawing Figures

Figure 1:
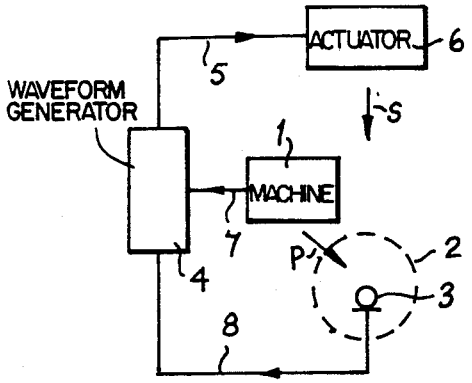
FIG. 1 (Prior Art)

METHOD OF AND APPARATUS FOR CANCELLING VIBRATIONS FROM A SOURCE OF REPETITIVE VIBRATIONS

It is known from U.S. Pat. No. 4,153,815 that repetitive vibrations (e.g. noise) emanating from a source of such vibrations can be at least partly nulled at some selected location (which may or may not be close to the source) by feeding to that location a specially generated secondary vibration which is synchronised to the source. If the source is a piece of machinery (e.g. an engine), the generation of the required waveform for the secondary vibration can be synchronised by a triggering signal extracted from the machinery (e.g. by using a magnetic or optical sensor placed close to a toothed wheel forming part of the machinery). With the secondary vibration locked to the primary vibration by the triggering signal, generation of the necessary secondary vibration to optimise the cancellation at the selected location, requires an adjustment of the waveform of the secondary vibration and this can be effected by a variety of different algorithms, the simplest of which would be a trial and error approach based on a monitoring of some parameter of the residual vibration sensed at the said location.

This invention relates to a method of and apparatus for cancelling vibrations from a source of repetitive vibrations which does not require a triggering signal to be extracted directly from the source of the primary vibrations.

According to one aspect of the invention a method of generating a synchronising signal for an active vibration cancelling system in which a primary vibration, from a source of repetitive vibrations, entering a location is at least partially nulled by a specially generated secondary vibration fed to the location, the synchronising signal being used to synchronise the secondary vibrations to said source, is characterised in that the synchronising signal is obtained from the output of a vibration sensor located at said location and influenced there by both the primary and secondary vibrations.

In one arrangement, the output from the residual vibration sensor can be monitored to extract therefrom a component (e.g. a low-frequency component) which has a repetition rate locked to the repetition rate of the source of the primary vibration, the monitored component being used to generate the synchronising signal.

Where, as could often be the case, it is desired to null all the frequency components of the primary vibration at the desired location, the arrangement described above will be in danger of losing synchronisation as the cancellation becomes increasingly successful, and it may then be desirable to reconstruct the primary vibration that is being nulled by adding to the residual signal a component derived from the secondary vibration source.

According to a further aspect of the invention, apparatus for cancelling a primary vibration entering a location from a source of repetitive vibrations, using a waveform generator synchronised to said source to generate a secondary vibration which is fed to said location and a vibration sensor in the location to sense the residual vibration remaining after the primary and secondary vibrations have interacted in the said location, is characterised in that the apparatus includes circuit means for deriving a synchronising signal for the waveform generator, which circuit means receives an input from said residual sensor.

The invention will now be further described, by way of example, with reference to the accompanying drawings, in which:

FIG. 1 is a schematic representation of a prior art apparatus for cancelling repetitive noise, and FIG. 2 to 5 are schematic representations of four different embodiments of apparatus according to the invention.

Referring to FIG. 1, in a known arrangement, a machine 1, which is a source of a primary repetitive vibration P, feeds that vibration into a location (shown dotted at 2) which includes a residual vibration sensor 3. A waveform generator 4 synthesises an electrical signal fed to a line 5 which causes an actuator 6 to generate a secondary vibration S, also fed to the location 2. Synchronising pulses are derived from the machine 1 and are fed, via a synchronising line 7, to the waveform generator 4 to ensure the secondary vibration S is locked to the primary vibration P and ensure a possibility for optimum cancellation of the latter in the location 2. This arrangement is well known (e.g. from U.S. Pat. No. 4,153,815), the output waveform from the generator 4 being adjusted to minimise the signal fed to a line 8 connecting the sensor 3 to the generator 4.

Figure 2:
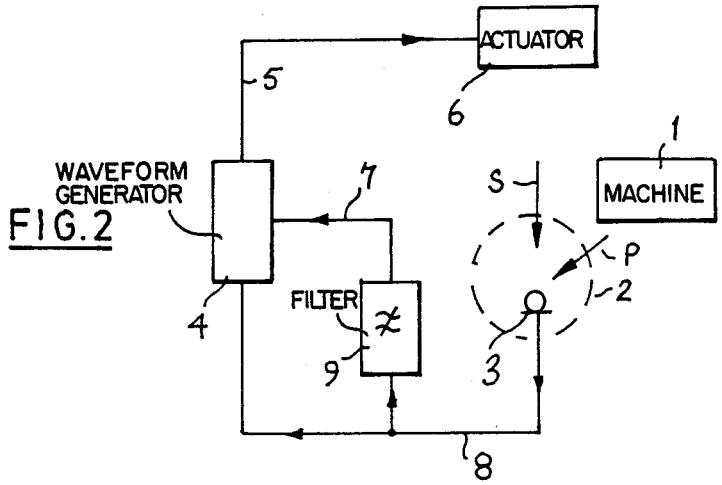

FIG. 2 shows a first embodiment of apparatus according to the invention, in which the same reference numerals have been used, as were used in FIG. 1, to designate similar integers. In the arrangement of FIG. 2, the output from the residual sensor 3 is led to a filter 9 which extracts a component thereof for supply to the synchronising line 7. The filter 9 can be a simple high-pass or band-pass filter which extracts a frequency component from the line 8 that is representative of the repetitive rate of the machine (or a whole-number multiple of that repetition rate). Where the repetition rate can be expected to vary considerably from time to time (e.g. in the case of a varying speed IC engine), the cut-off frequency or resonant frequency of the filter 9 can be made to track automatically to follow the monitored component. Such self-tracking filters are known and will not be more fully described here.

Figure 3:
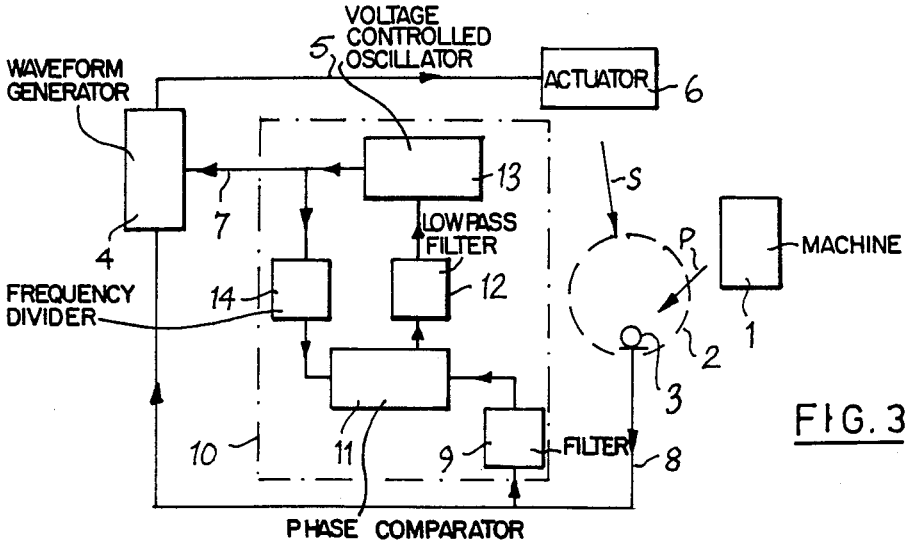

FIG. 3 shows a second embodiment of apparatus according to the invention and again uses the same reference numerals as FIG. 1, where appropriate. In FIG. 3, the synchronising signals fed to the generator 4 by the line 7 are derived from a frequency multiplying phase-locked loop generally designated 10.

The filter 9 in this case is a band-pass filter which feeds its output to a phase comparator 11 which defines a feed-back loop including a low-pass filter 12, a voltage controlled oscillator 13 and a frequency divider 14.

Using the apparatus of FIG. 3, the synchronisation signal is derived from the low frequency components of the residual signal on the line 8, by dividing down the signal from the voltage controlled oscillator 13 and phase locking the divided down signal to a filtered version of the residual signal received from the filter 9. As previously explained, the filter 9 can track the repetition rate of the machine 1. If the filtered component of the residual signal starts to slip out of phase with the output of the frequency divider 14, the VCO 13 will be adjusted to restore the required synchronism and ensure that a correct synchronising signal is, at all times, fed to the line 7.

Figure 4:
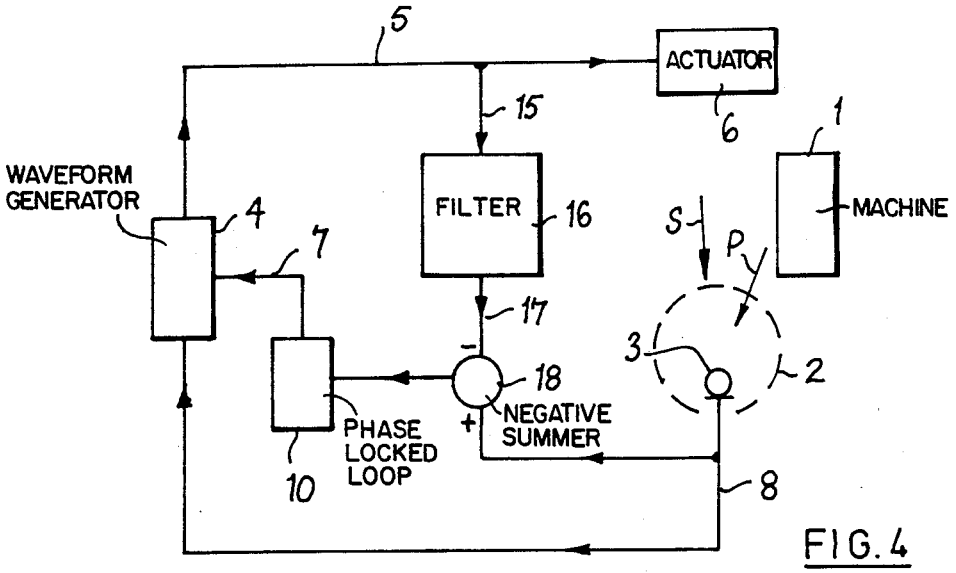

In cases where the residual component used to derive the synchronising signal is also one which it is desired to null, the pre-cancellation residual signal can be reconstructed by adding to the electrical residual signal on the line 8, a component related to that produced by the secondary vibration S, as shown in FIG. 4.

In this Figure, a signal is taken from the line 5 feeding the actuator 6, and is fed, via a line 15 to a filter 16 which compensates for the transfer function for the secondary vibration S from the actuator 6 to the residual sensor 3. The output from the filter 16 is fed to a line 17 to produce a signal thereon which precisely corresponds to what the output of the sensor 3 would be if the primary vibration P were not present in the location 2. In practice, the setting of the filter 16 can readily be obtained merely by stopping the machine 1 or by masking its primary vibration P from the location 2.

A negative summer 18 receives the signals on the lines 8 and 17 and feeds the line 7 directly or, as shown, via a frequency multiplying phase-locked loop 10.

Figure 5:
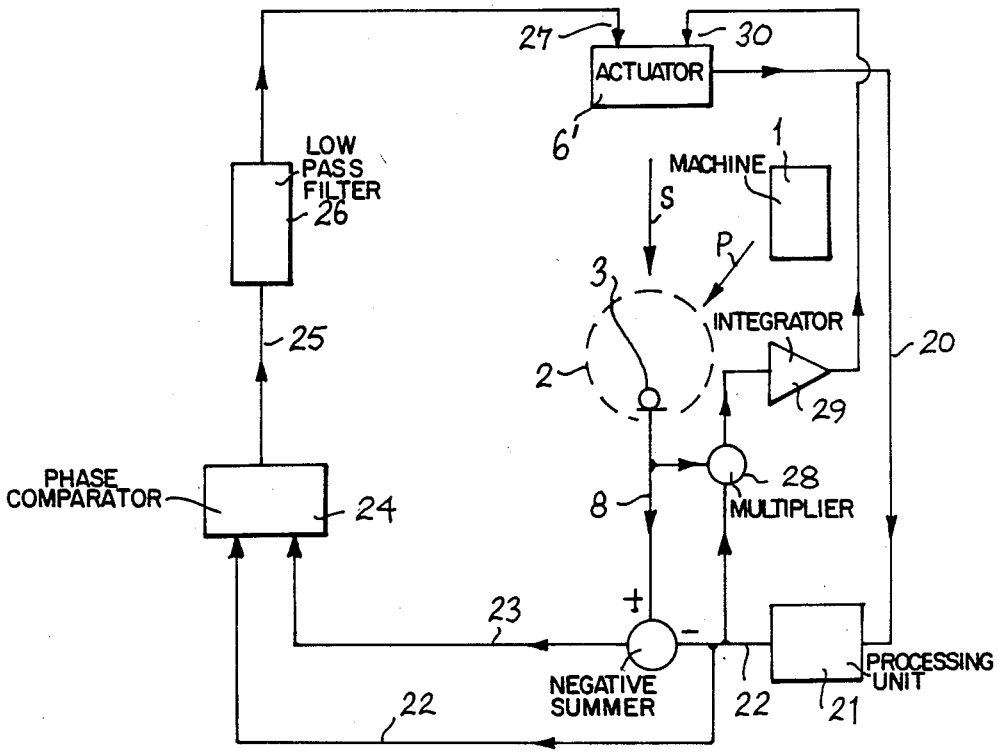

Some actuators 6 serving as cancelling transducers, accept as controlling inputs the amplitude and frequency of one or more sinusoidal components. Vibrators driven from contra-rotating weights and tuned resonant acoustic actuators fall into this category. In such cases, the sampled cancellation waveform is no longer necessary. The problem then reduces to controlling two parameters, amplitude and either phase or frequency, of each harmonic conponent. A phase-locked loop in which the loop includes the acoustic or vibrational path can then be considered. FIG. 5 illustrates an arrangement capable of cancelling a single component frequency whose amplitude is known to be varible. An actuator 6' is modified to produce an electrical output on a line 20 as well as the secondary vibration S, and this electrical output is processed in a unit 21 (which may be, in the simplest case, a direct electrical connection), to produce a signal on a line 22 which is equivalent to the effect of the actuator 6' on the residual sensor 3. By subtracting the processed signal on the line 22 from the measured residual signal on the line 8, the uncancelled noise or primary vibration signal can be extracted from the residual signal on a line 23. These two signals are then used to control the frequency of the actuator 6'.

In FIG. 5, the lines 22,23 lead to a phase comparator 24 which will produce an output on a line 25 when there is a phase difference between the signals on the lines 22 and 23. Via a low pass filter 26, the required frequency control signal is fed to the frequency control tap 27 of the actuator 6'.

FIG. 5 also shows how the amplitude control for the actuator 6' is derived. A multiplier 28 receives signals from the lines 22 and 8 and feeds its output to an integrator 29 which, in turn, feeds its output to the amplitude control tap 30 of the actuator 6'.

Further possible methods of extracting the correlated residual signal could involve peak amplitude measurement, and phase extraction from the residual signal.

Most cancelling systems would require a combination of frequency and amplitude control systems.

Systems for cancelling a number of harmonically related frequencies are possible consisting of a number of the arrangements of FIG. 5 in parallel or in cascade.

Any or all of the above-mentioned arrangements can be applied to provide cancellation either at the source of the primary vibration or in a localised region around the residual sensor.

In cases where the repetition rate of the source 1 is sensibly constant, the synchronisation signal could be generated from an independent oscillatory source of pulses, such that the repetition rate of the cancelling waveform is close to the repetition rate of the primary vibration P from the machine.

If the oscillator frequency exactly equals a multiple of the repetition rate of the source 1, the situation is functionally indistinguishable from that of synchronised cancellation as shown in FIG. 1.

Provided the adaption of the generator 4 is sufficiently rapid, some slippage between the repetition rate of the cancelling waveform and that of the source 1 could be tolerated while maintaining useful degrees of cancellation. The slippage will result in a demanded rate of change in the cancelling waveform, to prevent a beating effect between the cancelling waveform and the source. The rate of change of the amplitude of a cancelling waveform element will be greater at higher frequencies, so the cancellation to be expected from a system whose osillator frequency is not completely constant would be greatest at the fundamental and lower harmonic frequencies.

We claim:

1. A method of generating a synchronising signal for an active vibration cancelling system in which a primary vibration, from a source of repetitive vibrations, entering a location is at least partially nulled by a specially generated secondary vibration fed to the location, the synchronising signal being used to synchronise the secondary vibrations to said source of repetitive vibrations, characterised in that the synchronising signal is obtained from the output of a residual vibration sensor located at said location by combining an electrical output from the vibration sensor with an electrical signal derived from the source of the secondary vibration.

2. A method as claimed in claim 1, characterised in that the output from the residual vibration sensor is monitored to extract therefrom a frequency component which has a repetition rate locked to the repetition rate of the source of the primary vibration, the monitored component being used to generate the synchronising signal.

3. A method as claimed in claim 1, characterised in that the combining of an electrical output from the vibration sensor and the electrical signal derived from the source of the secondary vibration, substantially represents what the output of said vibration sensor would be if the primary vibration alone were entering the said location.

4. A method as claimed in claim 1, characterised in that the electrical signal derived from the source of the secondary vibration is a modified version of the driving signal fed to said source and corresponds to what the output of said vibration sensor would be, if the primary vibration were not present in the said location.

5. Apparatus for cancelling a primary vibration entering a location from a source of repetitive vibrations, using a waveform generator synchronised to said source of repetitive vibrations to generate a secondary vibration which is fed to said location and a residual vibration sensor in the location to sense the residual vibration remaining after the primary and secondary vibrations have interacted in the said location, characterised in that the apparatus includes circuit means for deriving a synchronising signal for the waveform generator, which circuit means receives an input from said residual sensor, the output from the residual sensor then being fed to a negative summer which also receives a signal derived from the output of said waveform generator, the output of said negative summer being used in a phased-locked loop to generate said synchronizing signal.

6. Apparatus as claimed in claim 5, characterised in that the output from the residual sensor is fed both to the waveform generator and a phase-locked loop, an output of the phase-locked loop being fed as the synchronising signal to the waveform generator.

7. A method of generating a synchronising signal for an active vibration cancelling system in which a primary vibration, from a source of repetitive vibrations, entering a location is at least partially nulled by a specially generated secondary vibration fed to the location, the synchronising signal being used to synchronise the secondary vibrations to said source of repetitive vibrations, characterised in that the synchronising signal is obtained from the output of a residual vibration sensor located at said location by combining an electrical output from the vibration sensor with an electrical signal derived from a drive signal of the source of the secondary vibration.

8. Apparatus for cancelling a primary vibration entering a location from a source of repetitive vibrations, using a waveform generator synchronised to said source of repetitive vibrations to generate a secondary vibration which is fed to said location and a residual vibration sensor in the location to sense the residual vibration remaining after the primary and secondary vibrations have interacted in the said location, characterised in that the apparatus includes circuit means for deriving a synchronising signal for the waveform generator, which circuit means receives an input from said residual sensor, means to produce a first electrical signal which is equivalent to the electrical output of the vibration sensor due to the effect of the secondary vibration thereon, and further means to derive from said first electrical signal, and the electrical output of said vibration sensor when influenced by both the primary and secondary vibrations, a second electrical signal which is fed with the first electrical signal to phase comparing means for generating the required synchronizing signal.

* * * * *